US006328639B1

(12) United States Patent
Pujol

(10) Patent No.: US 6,328,639 B1
(45) Date of Patent: Dec. 11, 2001

(54) SYSTEM FOR ABRASIVELY CLEANING SMALL PARTS AND A CONTAINER FOR HOLDING SMALL PARTS UNDERGOING ABRASIVE CLEANING

(76) Inventor: Marlon Pujol, 200 Hammonton Pl., Silver Spring, MD (US) 20904

( * ) Notice: Subject to any disclaimer, the term of this patent is extended or adjusted under 35 U.S.C. 154(b) by 0 days.

(21) Appl. No.: 09/594,015

(22) Filed: Jun. 15, 2000

(51) Int. Cl.[7] ..... B24C 9/00

(52) U.S. Cl. ..... 451/89; 451/38; 451/40; 451/90; 451/103; 451/104; 451/113; 451/326; 134/104.3; 134/117; 134/135; 134/151

(58) Field of Search ..... 451/38, 40, 89, 451/90, 103, 104, 113, 326; 734/104.3, 117, 135, 151

(56) References Cited

U.S. PATENT DOCUMENTS

| | | | |
|---|---|---|---|
| 2,601,364 | 6/1952 | Byrnes . | |
| 4,949,738 | 8/1990 | Hubbard . | |
| 5,044,387 | 9/1991 | Hsu . | |
| 5,209,784 | 5/1993 | Bellman . | |
| 5,453,039 | 9/1995 | Weintraub . | |
| 5,988,190 * | 11/1999 | Borges | 134/117 |

* cited by examiner

*Primary Examiner*—Joseph J. Hail, III
*Assistant Examiner*—Shantese McDonald

(74) *Attorney, Agent, or Firm*—Antonelli, Terry, Stout & Kraus, LLP

(57) ABSTRACT

A system for abrasively cleaning small parts, and a container for holding small parts undergoing abrasive cleaning. An abrasive cleaning cabinet has a bottom member and a cover hingedly connected to the bottom member. The cover is pivotable between a closed position in which the cover is closed against the bottom member to define a cleaning chamber therewithin and an open position permitting access into the cleaning chamber. The cover has a viewing window and a pair of arm apertures through it, with a glove attached to each arm aperture and extending into the cleaning chamber to permit insertion of a person's hands through the arm apertures and into the gloves in the cleaning chamber. The container includes a housing having an elongated body with a first end and a second end, a closure member attached to the housing first end, for closing the first end, a screen member removably attached to the housing second end, for closing the second end while permitting passage of abrasive material through the screen member but preventing passage of the small parts. A nozzle within the cleaning cabinet can be connected to a high pressure source of abrasive material. The person whose hands are in the gloves can grip the nozzle and the container, while the small parts are in the container, and can insert the nozzle outlet through an aperture in the container screen member and into the container. The person can then controllably spray abrasive material from the nozzle outlet into the container and into contact with the small parts to abrasively clean the small parts. Much of the abrasive material ultimately passes through the screen member and out of the container due to the high pressure from the nozzle.

12 Claims, 1 Drawing Sheet

SYSTEM FOR ABRASIVELY CLEANING SMALL PARTS AND A CONTAINER FOR HOLDING SMALL PARTS UNDERGOING ABRASIVE CLEANING

FIELD OF THE INVENTION

The present invention pertains to a system for abrasively cleaning small parts, and to a container for holding small parts undergoing abrasive cleaning. More particularly, the present invention pertains to such a system and container having the ability to retain the small parts securely as undergo abrasive cleaning, while minimizing the danger of dropping of the small parts, which might result in the parts becoming lost within the used abrasive material.

BACKGROUND OF THE INVENTION

In various businesses and industries, it is desirable to be able to clean small parts. By way of example, is often desired to clean small automotive parts, to remove grease, oil, paint, dirt, or other contaminants. Such small parts are frequently cleaned in an abrasive blast cleaning cabinet, sometimes referred to as a bead blaster. A typical abrasive blast cleaning cabinet is illustrated in U.S. Pat. No. 5,453,039 and is there described as including an abrasive collector bin and a cover member having a viewing window and arm apertures, with gloves attached to the arm apertures so that a persons hands can be inserted into the gloves to grip small parts within the abrasive blast cleaning cabinet. However, use of the abrasive blast cleaning cabinet in this manner requires the person to hold the small parts as they are being cleaned by blasting with abrasive material, such as sand. This inhibits the abrasive material from reaching all locations on the small parts and further presents the hazard of the person inadvertently dropping the small parts, with the result that the small parts become lost within used abrasive material that has collected on the bottom of the cleaning cabinet. To avoid this, those small parts having a suitable opening might be strung on a wire which is suspended in the abrasive blast cleaning cabinet. However, this is time consuming and tedious. Further, many small parts do not have an opening for passage of such a wire. U.S. Pat. No. 5,453,039 proposes to overcome these problems by providing a cleaning basket having a cylindrical main body portion and a frusto-conical neck portion that fits within the upper end of the main body portion, with a screen closing the lower end of the main body portion. The neck portion lower end cooperates with the upper end of the main body portion to define an area that intercepts small parts that are agitated within the basket, reducing the likelihood that those small parts will exit the basket through the open upper end. The abrasive material passes through screen on the lower end of the abrasive cleaning basket, while the small parts are unable to pass through the screen. However, since the abrasive material flows readily through the screen, little agitation of the abrasive material and the small parts occurs during the cleaning process unless the person holding the basket shakes the basket with the small parts in it. This is difficult to do while directing the abrasive cleaning material into the open upper end of the basket. Even then, only minimal agitation of the abrasive cleaning material occurs before it passes through the screen. Consequently, even with this basket, cleaning of small parts is difficult and time consuming.

SUMMARY OF THE INVENTION

The present invention is a system for abrasively cleaning small parts, and a container for holding small parts undergoing abrasive cleaning. In accordance with the present invention, a container for holding small parts undergoing abrasive cleaning includes a housing having an elongated body, one end of which is closed by a removable closure member and the other end of which is closed by a removable screen member which permits passage of abrasive material through it but prevents passage of the small parts. The screen member has an aperture through it so that a nozzle outlet can be inserted through the aperture and into the container to permit flow of abrasive material from the high pressure nozzle outlet into the container and into contact with small parts within the container to abrasively clean the small parts. The abrasive material contacts the closed sides and closed first end of the container which cooperates with the high pressure of the abrasive material source to agitate the abrasive material. This causes agitation of the small parts, increasing the contact between the abrasive cleaning material and the small parts, and so increasing the efficiency of the cleaning process. In addition, the agitation of the cleaning material results in much of the abrasive cleaning material ultimately passing out of the container through the screen member.

In another aspect, the present invention is a system for abrasively cleaning small parts including an abrasive cleaning cabinet having a bottom member and a cover which is pivotable between a closed position and an open position, with the cover having an observation window and a pair of arm apertures with gloves attached to the arm apertures to permit insertion of a person's hands through the arm apertures and into the gloves in the interior of the cleaning chamber. A container as described above is provided, and a nozzle is provided within the cleaning cabinet, permitting the person whose hands are in the gloves to grip the nozzle and the container while the small parts are in the container, to insert the nozzle outlet through the aperture in the container screen member and into the container, and to controllably spray abrasive material from the nozzle outlet into the container and into contact with the small parts. The high pressure from the nozzle cooperates with the closed sides and closed first end of the container to cause agitation of the abrasive material, and thus of the small parts, abrasively cleaning the small parts. Much of the abrasive material ultimately passes through the screen member and out of the container due to agitation of abrasive material caused by the high pressure from the nozzle in cooperation with the closed sides and closed first end of the container, with that abrasive material collecting in the cabinet bottom member.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings:

DETAILED DESCRIPTION OF A PREFERRED EMBODIMENT

Figure 1:
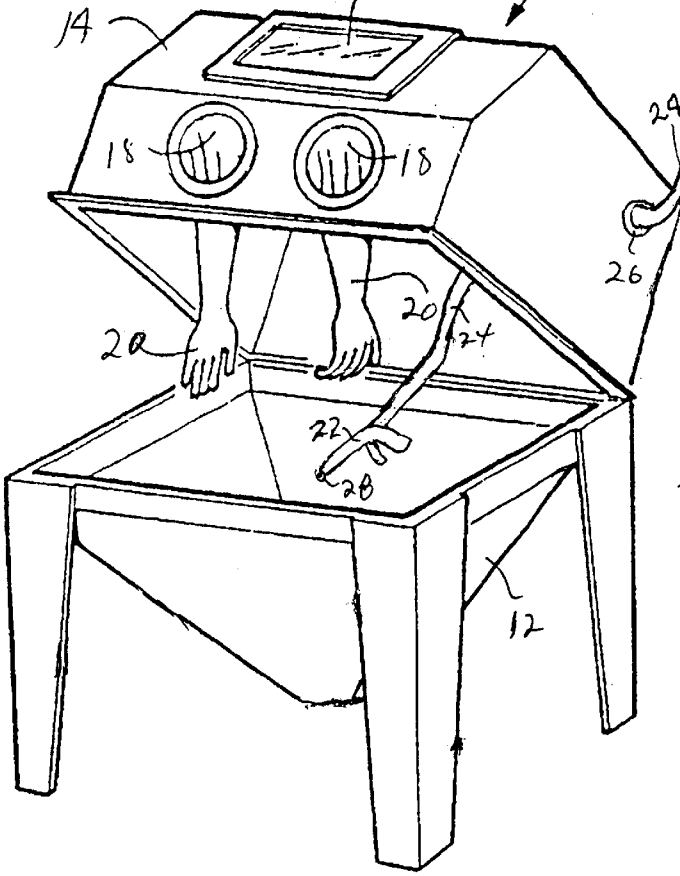
FIG. 1 depicts an abrasive cleaning cabinet in accordance with a preferred embodiment of the present invention.

FIG. 1 depicts an abrasive cleaning cabinet 10 which includes a bottom member 12 and a cover 14 that is hingedly connected to bottom member 12 so that cover 14 can pivot between a closed position in which the cover is closed against bottom member 12 to define a cleaning chamber therewithin and an open position permitting access into the cleanings chamber in the interior of the cleaning cabinet. Preferably, bottom member 12 is provided with an outlet (not shown) adjacent its lower end to permit easy removal of used abrasive cleaning material from the cleaning cabinet. Cover 10 has a viewing window 16 and two arm apertures 18 through it. A glove 20 is attached to each arm aperture 18 and extends into the interior of cleaning cabinet 10. Accordingly, a person's hands can be inserted through apertures 18 and into gloves 20, permitting the person to grip items within the cleaning chamber when cover 14 is closed.

A nozzle 22 is provided within cleaning cabinet 10 and is connected to a hose 24 which passes through an aperture 26 in cover 14 and is adapted to be connected to a suitable high pressure source of abrasive cleaning material (not shown). Accordingly, a person whose hands are in gloves 20 can grip nozzle 22 and control spraying of abrasive material from the outlet 28 of the nozzle.

Figure 2:
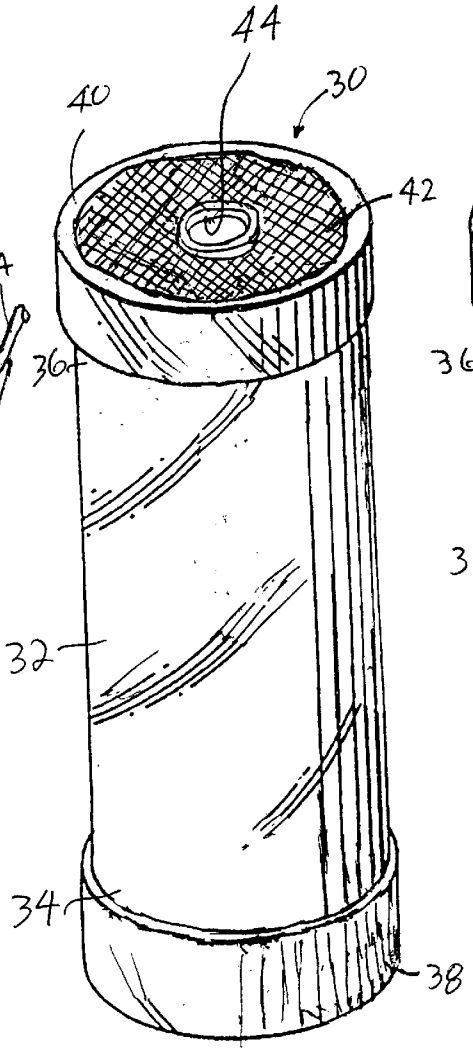
FIG. 2 depicts a preferred embodiment of a container for holding small parts within a cleaning cabinet such as that of FIG. 1, in accordance with the present invention.

FIG. 2 depicts a container 30 for holding small parts undergoing abrasive cleaning within cleaning cabinet 10. Container 30 includes a housing 32 having an elongated body with a first end 34 and a second end 36. A cover 38 closes first end 34. Cover 38 is preferably removable from housing 32, and by way of example might be threadedly connected to the housing.

A screen member 40 is removably connected to the second end 36 of housing 32, for example by a threaded connection. Screen member 40 includes a screen material 42 which extends substantially over the cross-section of housing 32. An aperture 44, suitably reinforced, is provided in screen material 42, for example at substantially the center of the screen material.

Figure 3:
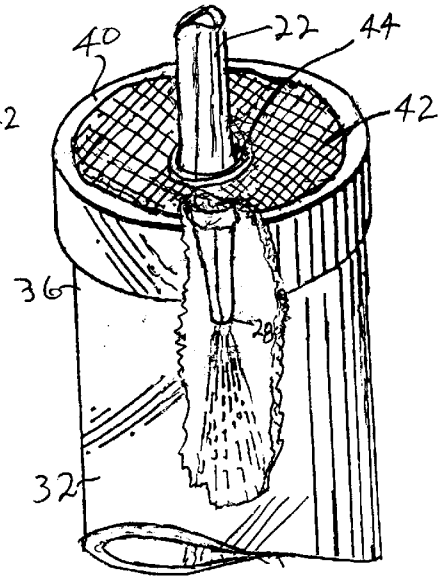
FIG. 3 is a fragmentary, partially broken view of the container of FIG. 2, showing the nozzle outlet inserted therein.

When it is desired to clean small parts, screen member 40 is removed from housing 32, and the small parts are placed within the housing. Screen member 40 is then put back on housing 32, and the housing is placed within cleaning cabinet 10. Cover 14 is pivoted to its closed position, and hose 24 is connected to a high pressure source of abrasive cleaning material. The person doing the cleaning inserts his or her hand into glove 20 and grips container 32 in one hand and nozzle 22 in the other. The outlet 28 of nozzle 22 is then inserted through aperture 44 into the interior of container 36, as depicted in FIG. 3. Nozzle 22 is then actuated, causing the abrasive material to spray into container 32. The abrasive material contacts the small parts and removes the grease, oil, dirt, paint, or other foreign matter from the parts. Because the high pressure flow abrasive material and the small parts are confined within container 32, which has closed sides and a closed bottom, the high pressure causes the abrasive material, and thus the small parts, to be rapidly agitated within container 32. The person can hold container 30 in any desired position. Agitation of the abrasive material and the small parts might be best obtained if container 30 is held up as depicted in FIG. 2, with screen member 40 at the upper end. This increases the cleaning effect of the abrasive material, shortening the time required for cleaning of the small parts. In addition, the high pressure causes much of the abrasive material to be ultimately discharged from container 32 through screen member 40. Accordingly, once the abrasive cleaning is completed and the high pressure flow of the abrasive cleaning material stopped, only a small amount of the abrasive material remains within container 32. Nevertheless, the screen 42 prevents the small parts from exiting container 32. Therefore, there is no danger of the small parts falling into bottom member 12 and becoming lost within the spent abrasive material that collects therein. The small amount of abrasive cleaning material remaining in container 30 might be removed by inverting container 30, either before the cleaned small parts are removed, with suitable blocking of aperture 44, or after the small parts have been removed.

It is accordingly seen that the present invention provides a system and a container for abrasively cleaning small parts which overcome shortcomings of the prior art and provide an improved cleaning of the small parts. Although the present invention has been described with reference to preferred embodiments, various alternations, rearrangements and substitutions might be made, and still the result would be within the scope of the invention.

What is claimed is:

1. A container for holding small parts undergoing abrasive cleaning, said container comprising:

a housing having an elongated body with a first end and a second end;

a closure member attached to said housing first end, for closing said first end;

a screen member removably attached to said housing second end, for closing said second end while permitting passage of abrasive material therethrough but preventing passage of the small parts therethrough, said screen member having an aperture therethrough for insertion of a nozzle outlet through the aperture and into said container to permit flow of abrasive material from the nozzle outlet into the container and into contact with small parts therein to abrasively clean the small parts, with much of the abrasive material ultimately passing through said screen member and out of said container.

2. A container as claimed in claim 1, wherein said closure member is removably attached to said housing first end.

3. A container as claimed in claim 1, wherein said housing is cylindrical.

4. A container as claimed in claim 3 wherein said closure member is threadedly attached to said housing.

5. A container as claimed in claim 3, wherein said screen member is threadedly attached to said housing.

6. A container as claimed in claim 1, wherein the screen member aperture is in substantially the center of said screen member.

7. A system for abrasively cleaning small parts, said system comprising:

an abrasive cleaning cabinet having a bottom member and a cover hingedly connected to said bottom member and pivotable between a closed position in which said cover is closed against said bottom member to define a cleaning chamber therewithin and an open position in which said cover opens said cleaning cabinet, permitting access into the cleaning chamber, said cover having a viewing window and a pair of arm apertures therethrough, with a glove attached to each arm aperture and extending into the cleaning chamber to permit insertion of a person's hands through the arm apertures and into said gloves in the cleaning chamber;

a container for holding the small parts within the cleaning chamber, said container comprising a housing having an elongated body with a first end and a second end; a closure member attached to said housing first end, for closing said first end; a screen member removably attached to said housing second end, for closing said second end while permitting passage of abrasive material therethrough but preventing passage of the small parts therethrough, said screen member having an aperture therethrough;

a nozzle within said cleaning cabinet, said nozzle having an outlet and being connectable to a high pressure source of abrasive material, permitting the person whose hands are in said gloves to grip said nozzle and said container while the small parts are in said container, to insert said nozzle outlet through the aperture in said screen member and into said container, and to controllably spray abrasive material from said nozzle outlet into the container and into contact with the small parts to abrasively clean the small parts, with much of the abrasive material ultimately passing through said screen member and out of said container due to the high pressure from said nozzle.

8. A system as claimed in claim 7, wherein said container closure member is removably attached to said container housing first end.

9. A system as claimed in claim 7, wherein said container housing is cylindrical.

10. A system as claimed in claim 9, wherein said closure member is threadedly attached to said container housing.

11. A system as claimed in claim 9, wherein said screen member is threadedly attached to said container housing.

12. A system as claimed in claim 7, wherein the screen member aperture is in substantially the center of said screen member.

* * * * *